US005766122A

United States Patent [19]

Hamilton

[11] Patent Number: 5,766,122

[45] Date of Patent: Jun. 16, 1998

[54] PAPER FOLDING APPARATUS

[76] Inventor: Wade D. Hamilton, 214 Allem La., Perkasie, Pa. 18944

[21] Appl. No.: 548,430

[22] Filed: Oct. 26, 1995

[51] Int. Cl.[6] ..... B31F 7/00

[52] U.S. Cl. ..... 493/420

[58] Field of Search ..... 493/420, 421, 493/419, 249, 417, 435, 476; 53/117; 271/2, 272; 270/58.06

[56] References Cited

U.S. PATENT DOCUMENTS

| | | | |
|---|---|---|---|
| 3,796,423 | 3/1974 | Shuster | 270/68 A |
| 4,573,672 | 3/1986 | Lehmann et al. | 270/45 |
| 4,834,699 | 5/1989 | Martin | 493/421 |
| 4,898,570 | 2/1990 | Luperti et al. | 493/420 |
| 5,041,074 | 8/1991 | Zwimpfer | 493/420 |
| 5,048,809 | 9/1991 | Tebbe et al. | 270/45 |
| 5,180,151 | 1/1993 | Branecky et al. | 270/45 |
| 5,180,357 | 1/1993 | Marzullo | 493/420 |
| 5,234,399 | 8/1993 | Boughton et al. | 493/420 |
| 5,269,744 | 12/1993 | Moll | 492/421 |

*Primary Examiner*—Daniel Moon
*Assistant Examiner*—John Paradiso
*Attorney, Agent, or Firm*—Dennis T. Griggs

[57] ABSTRACT

A paper folding apparatus has a buckle chute disposed between an inlet feed roller pair and an exit feed roller pair which are arranged to provide a substantially linear feed path for a paper article being folded and fed through the apparatus. The inlet feed roller pair is mounted on respective support members which permit adjustment of the position of one of the feed rollers of the inlet feed roller pair to change the path of the leading edge of the paper article as it moves through the inlet feed roller pair toward the buckle chute. A common drive gear is meshed with drive gears on rollers on each of the feed roller pairs and the feed roller drive gears are meshed with cooperating drive gears connected to the other rollers of each roller pair, respectively. The linear feed path through the folding station minimizes wrinkling of the article being folded and the production speed of the apparatus is significantly greater than conventional buckle chute folders which substantially change the direction of feeding of the folded article.

12 Claims, 4 Drawing Sheets

PAPER FOLDING APPARATUS

FIELD OF THE INVENTION

The present invention relates to a buckle-chute paper-folding apparatus having an improved feed roller drive assembly and a substantially linear paper feed path.

BACKGROUND OF THE INVENTION

Buckle-chute paper folding machines are used to fold a relatively heavy paper stock of the kind commonly used for envelopes in the mail and courier service industries. The significant volumes of paper material requiring folding operations in various uses of such material has fostered the need for paper-folding machines which are capable of high production rates, can accommodate a relatively wide range of paper weights and thicknesses and are capable of folding paper in a wide range of weights and thicknesses without wrinkling or otherwise damaging the paper.

DESCRIPTION OF THE PRIOR ART

Buckle-chute paper-folding machines have been developed which have a set of feed rollers feeding a sheet of paper stock into a buckle chute to create the folding action. One limitation on the use of conventional buckle-chute paper-folding machines is related to the significant change in direction that the entire sheet of paper must undergo during the paper feeding and folding operation. Known types of buckle-chute paper-folding machines typically force the paper being folded to undergo a change in direction of the feedpath of at least ninety degrees or more. Such bending action imposed on the paper article at points other than the fold itself can cause significant wrinkling and damage to relatively heavy paper stock, particularly the type of paper used for envelopes in the mail and courier service industries. Another limitation of prior art paper folding apparatus is that the production speed is limited by the overall arrangement of the inlet feed rollers and exit feed rollers, the buckle-chute and the significant change in direction of the paper article as it is fed through the folding apparatus.

Yet another limitation on the use of conventional buckle-chute paper-folding machines relates to the relatively complicated drive mechanism for driving the inlet feed rollers and exit feed rollers and the associated means, if any, for adjusting the relative positions of the feed rollers. In this regard, there is a continuing need to simplify the mechanical drive arrangement for the drive rollers and for adjusting the position of the inlet feed rollers relative to the buckle-chute to accommodate higher production speed. The present invention overcomes such limitations of conventional paper folding machines.

SUMMARY OF THE INVENTION

The present invention provides an improved buckle-chute folding apparatus for folding various weights of paper articles, including relatively heavy stock paper used in the production of overnight mail and courier service envelopes.

According to one important aspect of the present invention, a buckle-chute paper-folding apparatus is provided with respective sets of inlet and exit feed rollers for a paper folding station which are arranged with respect to each other and with respect to a buckle-chute so that the feed path of the article to be folded is substantially linear through the folding station. In this way, the paper article being folded is not subjected to substantial bending, except at the fold itself, thereby minimizing wrinkling and other damage to the paper article. Still further, the substantially linear or straight line arrangement of the respective sets of feed rollers improves the speed at which the apparatus is able to produce folded paper articles. The substantially linear feed path is provided by a single pair of folding station inlet feed rollers and exit feed or folding rollers, respectively, which are arranged spaced from and on opposite sides of a buckle chute.

According to another important aspect of the present invention, a buckle chute paper folding apparatus is provided wherein a single pair of folding station inlet feed rollers and exit feed rollers, respectively, are drivably connected to a common drive member. In particular, the rollers of the inlet feed roller pair are drivably connected by drive gears on the support shafts of the respective inlet feed rollers, the exit feed rollers are drivably connected by a pair of drive gears supported on the respective drive shafts of the exit feed rollers and a common drive gear is meshed with one of the drive gears of the inlet feed roller pair and the exit feed roller pair, respectively. By this arrangement, a common drive gear is provided for the respective pairs of feed rollers which assures reliable timing of the drive speeds of the inlet and exit feed rollers and provides a mechanically simplie drive train at the buckle chute folding station.

According to yet a further aspect of the present invention, a buckle chute paper folding apparatus is provided with an arrangement of folding station inlet feed rollers which may be adjusted to modify the direction of movement of the leading edge of the paper article as it approaches the buckle chute. One of the inlet feed rollers is mounted on spaced apart supports which may be pivoted about the axis of rotation of the other inlet feed roller which is drivably connected to a drive pinion. By adjusting the rotative position of one of the inlet feed rollers about the axis of the other feed roller an intermediate portion of the feed path of the leading edge of the paper article to be folded may be adjusted to assure smooth entry of the article into the buckle chute without premature buckling or damage to the article. The pivotally mounted supports for the inlet set of feed rollers also advantageously provide means for adjusting the engagement force between the rollers to enable these rollers to accommodate different paper weights, thicknesses and surface texture.

The operational features and advantages of the present invention will be understood upon reading the detailed description which follows with reference to the drawing figures.

DETAILED DESCRIPTION OF A PREFERRED EMBODIMENT

Figure 1:
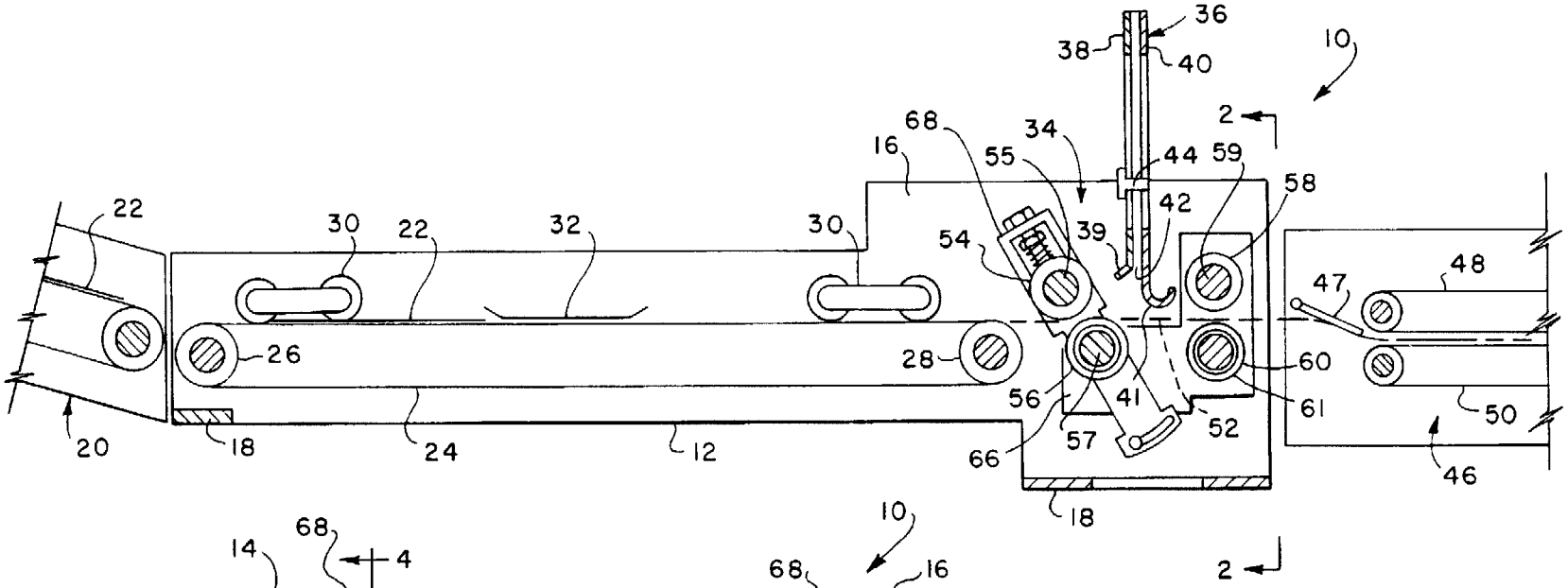
FIG. 1 is a longitudinal side elevation section view, in simplified schematic form, of an improved paper folding apparatus constructed according to the present invention.

In the description which follows, like parts are marked throughout the specification and drawing with the same reference numerals, respectively. The drawing figures may not necessarily be to scale in the interest of clarity and conciseness.

Figure 2:
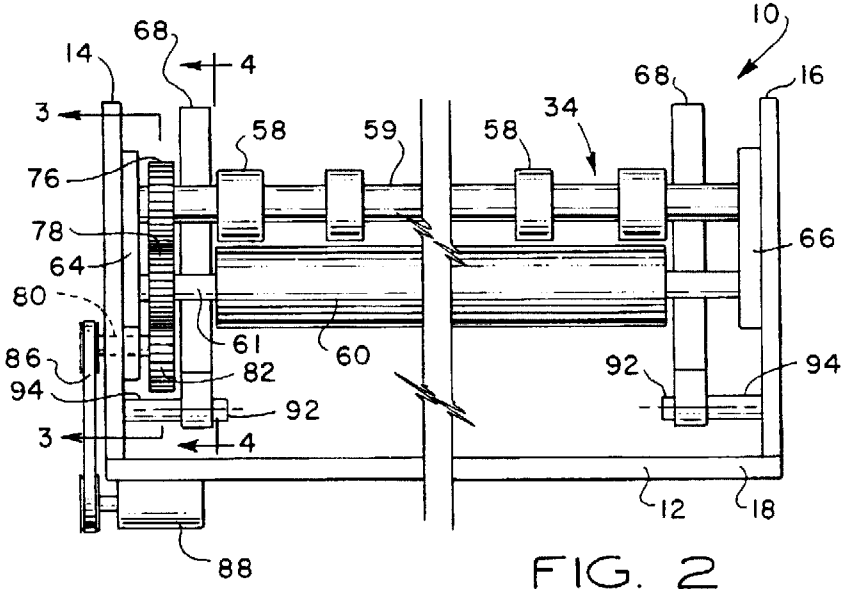
FIG. 2 is an end elevational view taken generally from the line 2—2 of FIG. 1.

Referring to FIGS. 1 and 2, there is illustrated a unique buckle chute type paper folding apparatus, generally designated by the numeral 10. The apparatus 10 includes a frame 12 having spaced apart upstanding support plates 14 and 16, FIG. 2, interconnected by suitable transverse members 18, for example. The apparatus 10 is shown aligned with a suitable singulation feeder 20, FIG. 1, for feeding, seriatim, substantially flat paper articles 22, to be folded by the apparatus 10. The frame 12 supports one or more endless prefeed belts 24, one shown, suitably trained over spaced apart drive rollers 26 and 28. One or more sets of guide rollers 30 and guide shoes 32, respectively, are operable to guide an article 22 along the belt 24 toward a folding station, generally designated by the numeral 34.

The folding station 34 is characterized by a generally vertically extending buckle chute 36 formed by two spaced apart plates 38 and 40 which are suitably supported on the frame 12 and provide an inlet opening or mouth 42 at the lower end of the plates, respectively. Adjustable stop means 44 is suitably supported for substantially vertical movement on the chute 36 to adjust the length of a fold in an article 22 to be performed at the folding station 34. A post feed or stacking apparatus is shown disposed adjacent to the folding station 34 and is generally designated by the numeral 46. The apparatus 46 is characterized by one or more flexible guide fingers 47 and spaced apart endless drive belts 48 and 50, which are operable to collect and stack the folded articles after they pass through the folding station 34.

The apparatus 10 provides an improved folding station arrangement utilizing a buckle chute wherein paper articles 22 pass through the folding station 34 along a substantially in-line or linear, and preferably horizontal feedpath, generally designated by the numeral 52 in FIG. 1. In other words, the direction of movement of a paper article 22 as it is fed from the prefeed belt 24 to the post feed or stacking apparatus 46 follows a substantially linear path, as indicated by the dashed line 52, whereby the article undergoes minimal change in direction of movement. The feedpath 52 is preferably substantially horizontal, although not necessarily so.

This improved feedpath 52 is provided by a unique arrangement of a pair of folding station inlet feed rollers 54 and 56 and a pair of folding station exit feed or folding rollers 58 and 60, as shown in FIG. 1. The roller pair 54, 56 is disposed on one side of the buckle chute 36 and the roller pair 58, 60 is disposed on the other side of the buckle chute. However, the nips of the roller pairs 54, 56 and 58, 60 are substantially aligned along the feedpath 52. The buckle chute 36 is disposed downstream of the feed roller pair 54, 56 in regard to the direction of movement of the article 22 through station 34. Moreover, the roller pair 54, 56 is mounted on unique support means operable to adjust the angle of the feeding direction of the roller pair 54, 56 for feeding the leading edge of a paper article 22 with respect to the buckle chute 36, as will be described in further detail herein.

As further shown in FIG. 1, the buckle chute 36 has an inlet flange 39 formed at the lower end of the plate 38 and a curved guide surface 41 disposed above the feed path 52 and preferably formed contiguous with the plate 40. The buckle chute 36 is suitably supported between the side plates 14 and 16 of the frame 12 and the chute 36 has been omitted from drawing FIG. 2 in the interest of clarity. The rollers 54, 56, 58 and 60 are each suitably supported on respective rotatable support shafts 55, 57, 59 and 61, as shown in FIG. 1.

Each of the shafts 57, 59 and 61 is supported at its opposite ends by suitable bearing means, not shown, disposed in spaced apart bearing housings 64 and 66, respectively, as shown in FIG. 2. The bearing housings 64 and 66 are suitably mounted on the frame side plates 14 and 16, respectively. The roller 54 is rotatably supported on a pair of unique support members 68, FIGS. 1 and 2, which are journalled on opposite ends of the shaft 57 and are operable to be secured in selected angular positions with respect to the feedpath 52 in a manner to be described further herein.

Figure 3:
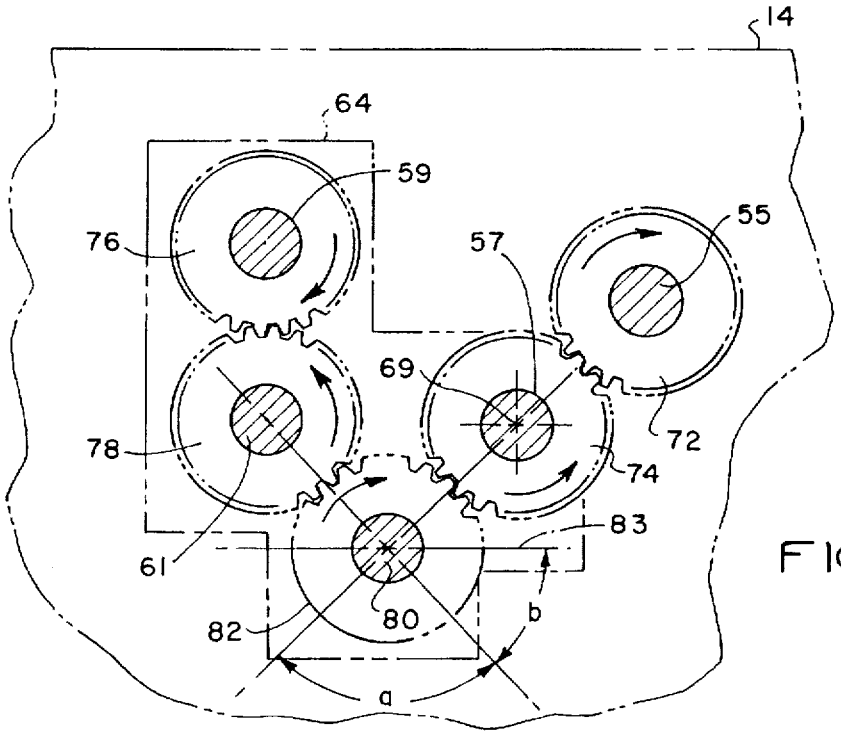
FIG. 3 is a detail view of the drive gear train for the feed rollers, taken generally from the line 3—3 of FIG. 2.

FIG. 3 shows a preferred geometry for the gear train wherein angles "a" and "b" are 100° and 40°, respectively. The center lines forming these angles pass through the axes of rotation of gears 74, 78 and 82 and line 83 is parallel to feedpath 52. Referring further to FIGS. 2 and 3, the apparatus 10 includes a unique drive train for the folding station inlet and exit feed roller pairs. In particular, as shown in FIG. 3, the shafts 55 and 57 are each drivenly connected to and support respective drive gears 72 and 74 which are meshed with each other. In like manner, the shafts 59 and 61 support and are drivenly connected to respective drive gears 76 and 78 which are also meshed with each other. Lastly, a drive shaft 80 is supported for rotation on the frame side plate 14, FIG. 2, and is drivably connected to a drive pinion 82 which is meshed with the drive gears 74 and 78, FIG. 3.

The drive gears 72, 74, 76 and 78 may be virtually identical in configuration, and have the same pitch diameter and numbers of teeth, respectively. The drive pinion 82 may have a different number of teeth from the other drive gears depending on the preferred speed ratio for the entire drive train. Accordingly, the rollers 54, 56, 58 and 60 are all driven at the same rotative and surface speeds, since these rollers are preferably all of the same outer diameter. As shown in FIG. 2, the drive shaft 80 is operably connected to drive means such as an endless roller chain 86 which is connected to a suitable drive motor 88 mounted on the frame 12. Moreover, as shown in FIG. 2, the drive gearing comprising the gears 72, 74, 76, 78 and 82 are arranged inboard of the support plates 14 and 16 and between the support plate 14 and one of the support members 68. Accordingly, a compact and out-of-the-way drive train is provided for the folding station 34 as will be appreciated by those skilled in the art.

Figure 4:
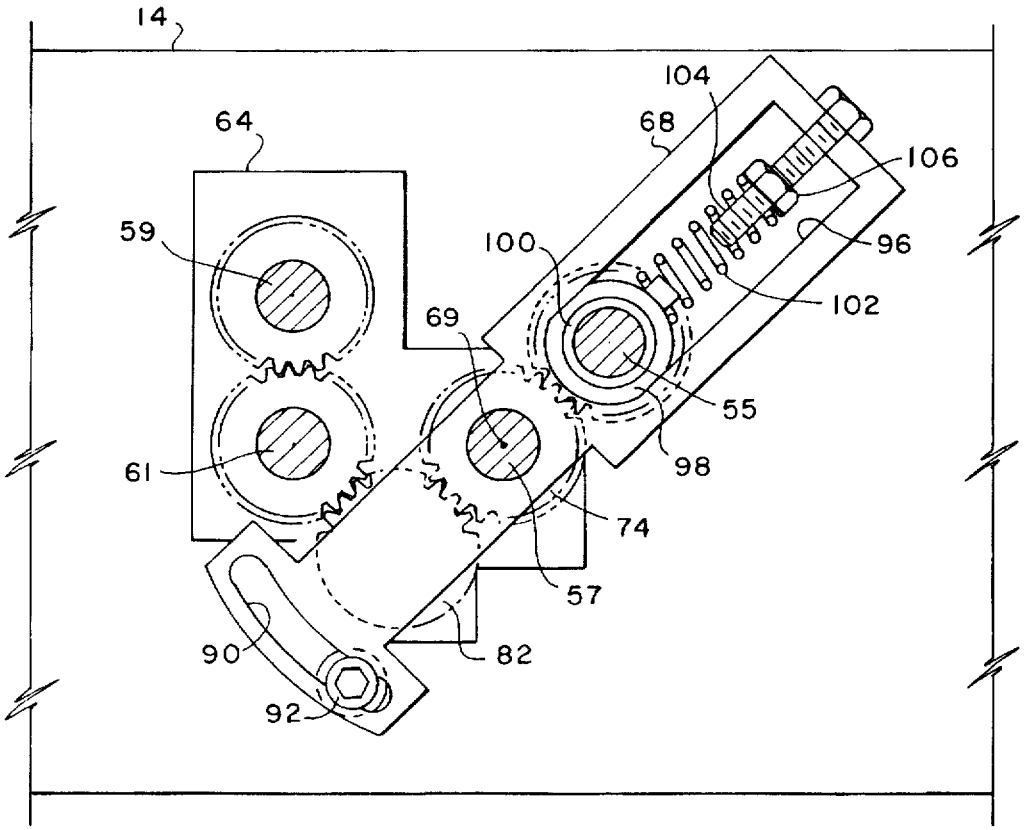
FIG. 4 is a view taken generally from the line 4—4 of FIG. 2.

Referring now to FIG. 4, certain features of one of the support members 68 are illustrated. The support members 68 are suitably journalled on and adjacent opposed ends of the shaft 57, respectively and are rotatable about the longitudinal central axis 69 of the shaft 57. The support members 68 each include an arcuate slot 90 formed adjacent one end through which suitable threaded fasteners 92 project and are, respectively, threadedly engaged with opposed bosses 94, FIG. 2, disposed on the respective frame side plates 14 and 16.

As further shown in FIG. 4, each support member 68 includes an elongated slot 96 formed therein and operable to slidably support a bearing housing 98 having a suitable bearing 100 disposed therein for rotatably supporting the shaft 55. The bearing housing 98 is movable in the slot 96 and is biased in a position to move roller 54 toward the roller 56 and its support shaft 57 by a compression spring 102 which is engaged with the housing 98 and is sleeved over the distal end of a bolt 104 supported on and threadedly engaged with one end of the support member 98. The spring 102 is engaged with a nut 106 threadedly disposed on the bolt 104 and operable to be adjusted to vary the compression force of the spring for yieldably biasing the roller 54 toward the roller 56.

Thanks to the arrangement of the support members 68 for supporting the roller 54 for rotation about the axis 69 of the roller 56, the so-called pitch angle of the feed roller set 54, 56 with respect to the mouth 42 of the buckle chute 36 may be adjusted as desired without substantially modifying the linearity of the feed path 52. In the drawing figures one substantial limit position of the support members 68 is illustrated wherein the angle of the exit path of the roller pair 54, 56 is substantially at a maximum with respect to the feed path 52. The attitude of the leading edge of a paper article exiting the roller pair 54, 56, with respect to the buckle chute 36, may be adjusted by rotating the support members 68 about the axis 69 to a selected position anywhere between the limit positions provided by the slots 90.

Figure 5:
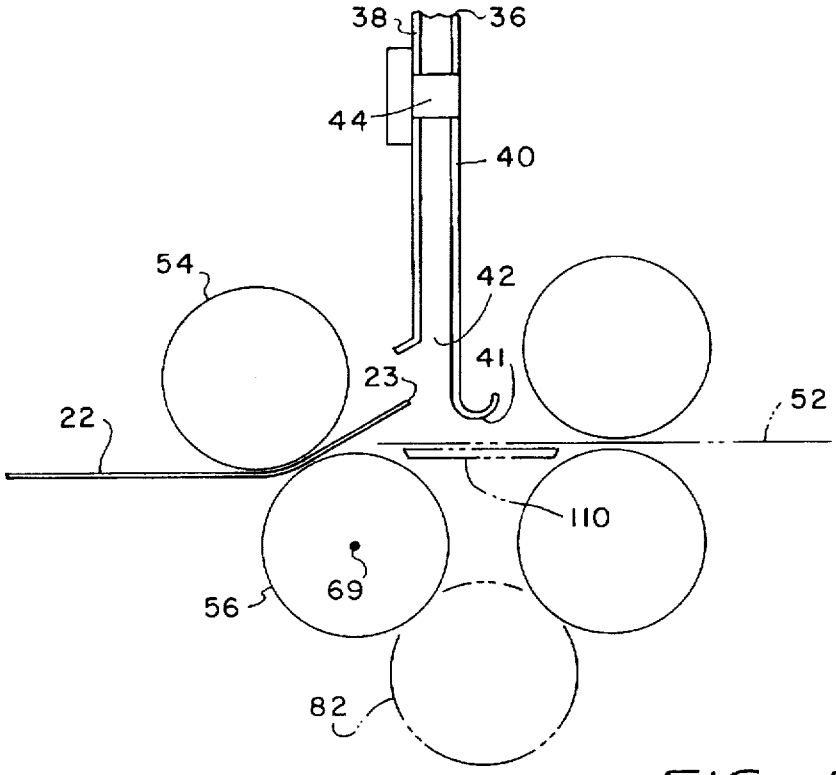
FIGS. 5–8 are schematic diagrams showing, sequentially, the positions of a paper article being folded by the apparatus of the present invention.

Referring now to FIGS. 5–8, a folding operation to provide a fold in a paper article 22 will now be described. FIGS. 5 through 8 are taken in the same viewing direction as FIG. 1. As shown in FIG. 5, as the leading edge 23 of a paper article 22 moves between the rollers 54 and 56, this edge is pitched somewhat upwardly toward the mouth 42 of the buckle chute 36. The pitch angle or direction of movement of leading edge 23 may be changed by rotating the support members 68 for the roller 54 about the axis 69 in a clockwise direction, for example, viewing FIG. 5, so that the roller 54 is more vertically oriented with respect to the roller 56. The angular position of the roller 54 about the axis 69 is selected in accordance with the thickness, stiffness and surface characteristics of the paper article 22 and may be varied at will, as will be appreciated from the foregoing description.

Figure 6:
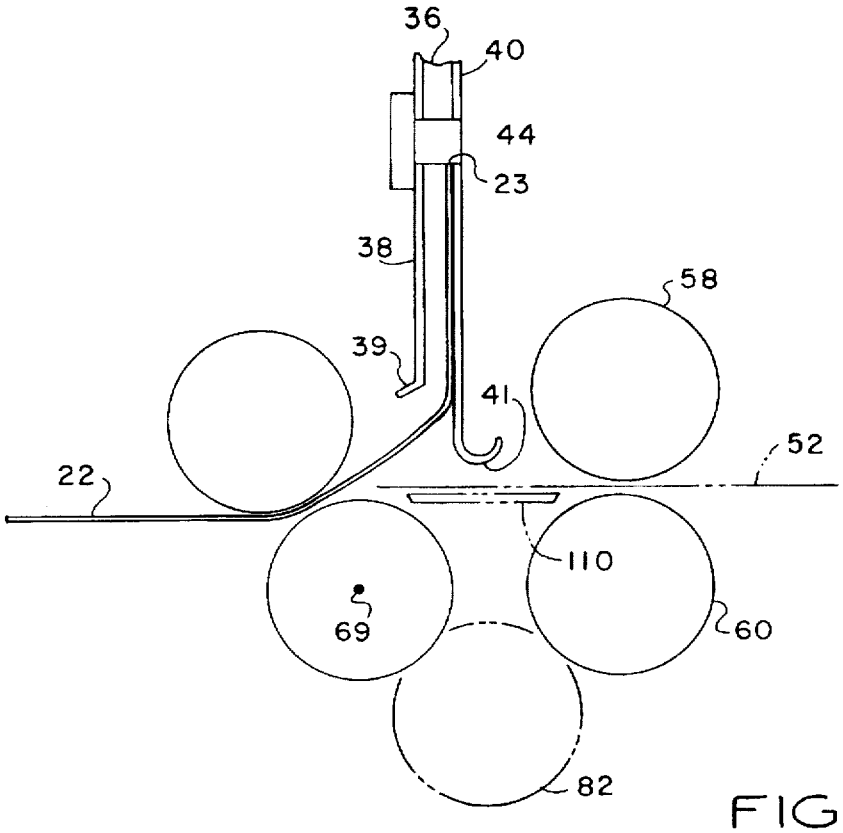

Referring to FIG. 6, as the leading edge 23 of the paper article 22 moves into the slot formed between the buckle chute plates 38 and 40, the article will continue to be fed into the slot until the leading edge hits the stop 44. At this time, a fold or buckle in the article 22 will begin to form since the feed rollers 54 and 56 are continuously feeding the article 22 along the feed path 52.

Figure 7:
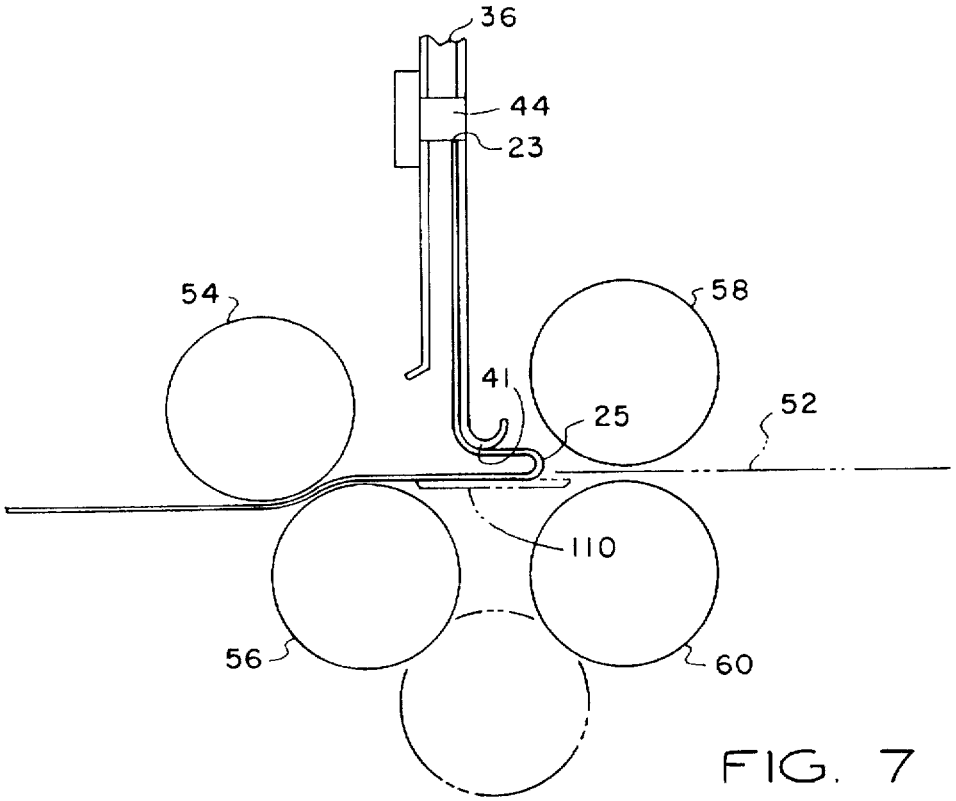

Accordingly, as shown in FIG. 7, continued feeding of the paper article 22 by the roller pair 54, 56 will cause the article to bend around the curved surface 41 on the plate 40 to form a fold edge or crease 25 of a fold in the article 22. Once this crease or fold edge 25 has been formed, continued feeding of the article 22 will move it toward the exit feed rollers 58, 60.

Figure 8:
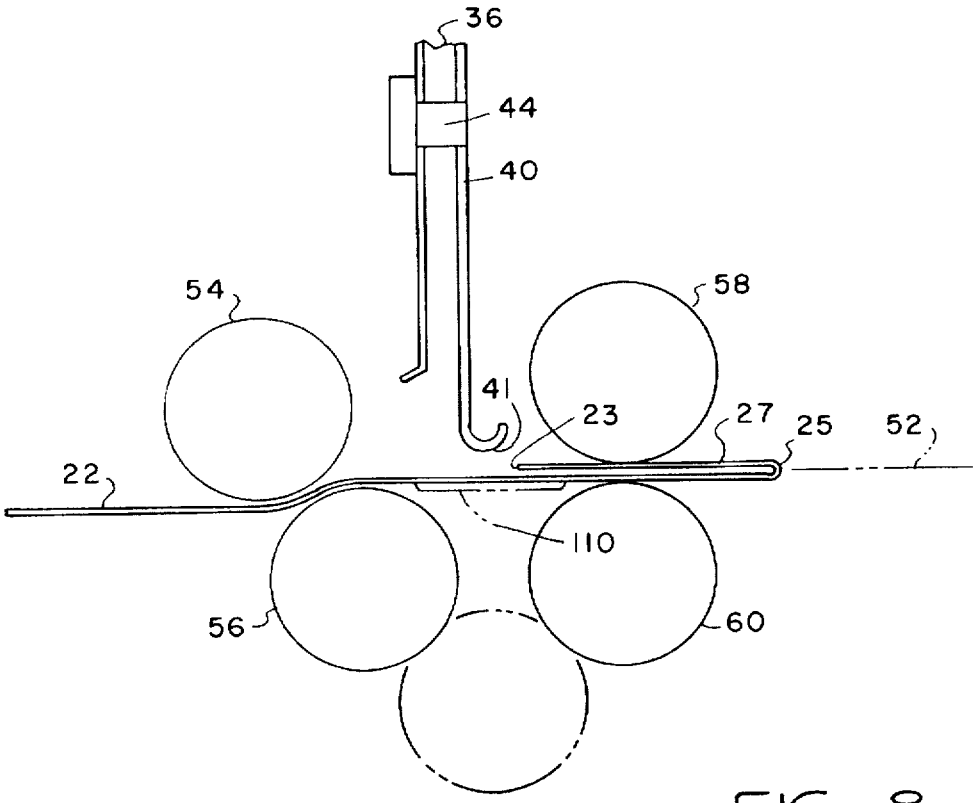

FIG. 8 shows the article 22 being fed through the exit feed rollers 58, 60 downstream of the chute 36 in the feeding direction to complete the folding operation wherein a fold portion 27 of the article 22 has been formed. The article 22 is then quickly ejected from the exit feed roller pair 58, 60 and moves between the belts 48, 50 of the apparatus 46, FIG. 1.

Those skilled in the art will appreciate from viewing the schematic diagrams of FIGS. 5-8 that a paper article 22 may be rapidly folded by the apparatus 10 without substantial bending of the article except at the fold line 25 and the fold portion 27, thanks to the arrangement of the inlet feed roller pair 54, 56 in relation to the buckle chute 36 and the exit feed roller pair 58, 60. The arrangement of these feed roller pairs provides a substantially linear feed path through the folding station 34, which path may have an intermediate portion which is only slightly non-linear, depending on the pitch angle imposed on the leading edge of a paper article by the roller pair 54, 56 with respect to the buckle chute 36. This avoidance of substantial change of direction of the paper article 22 or severe bending of the article around one or more feed rollers improves the speed with which the article 22 may be fed through the folding station 34 and minimizes wrinkling or other damage to the article.

In producing decorated envelopes, for example, only the eventually unseen fold 27 is subjected to substantial bending during the folding operation. If the paper article 22 is relatively lightweight, it may be desirable to provide a guide plate 110, FIGS. 5–8, interposed between the rollers 56 and 60, being substantially coextensive with these rollers and being disposed below the guide surface 41 of the buckle chute 36. In this way, relatively lightweight paper articles which might tend to follow the surface of the roller 56 are prevented from failing to follow the feedpath 52. Use of the guide plate 110 may not be necessary when folding relatively heavy paper stock such as used for mail and courier service envelopes.

The apparatus 10 may be fabricated using conventional engineering materials for paper folding machines as well as conventional fabrication techniques for forming the elements of the apparatus described above. The rollers 54, 56, 58 and 60 may be formed of suitable elastomeric materials used in paper handling apparatus of the general type described hereinabove. The apparatus 10 may be operated continuously by feeding, seriatim, paper articles 22, suitably spaced apart along the prefeed belts 24 to the folding station 34 wherein the articles are rapidly folded at the folding station by the action of the inlet feed roller pair 54, 56, the buckle chute 36 and the exit feed roller pair 58, 60. The speed of feeding paper articles such as overnight mail and courier service envelopes may be increased as much as fifty percent using the apparatus 10 as compared with prior art apparatus. Moreover, the improved drive gear train described above, is economical to manufacture, compact and provides a unique arrangement for driving plural sets of feed rollers in a paper folding machine of the general type described.

Although one preferred embodiment of a paper folding apparatus in accordance with the invention has been described in detail herein, those skilled in the art will recognize that various substitutions and modifications may be made to the apparatus without departing from the scope and spirit of the invention as recited in the appended claims.

What is claimed is:

1. A paper folding apparatus having a folding station for performing a fold on a paper article, said folding station being characterized by:

inlet feed roller means at said folding station for feeding said paper article thereto;

a buckle chute disposed downstream along a feed path from said inlet feed roller means in the direction of movement of said paper article;

exit feed roller means disposed downstream along said feed path in the direction of movement of said paper article with respect to said buckle chute, said inlet feed roller means, said buckle chute and said exit feed roller means being arranged such that said feed path through said folding station is substantially linear;

said inlet feed roller means including a first pair of feed rollers rotatably supported on said apparatus and said exit feed roller means including a second pair of feed rollers rotatably disposed on said apparatus;

said inlet feed rollers are disposed on spaced apart support means operable to adjust the position of said inlet feed rollers with respect to said buckle chute to feed a leading edge of said paper article toward said buckle chute;

said support means for said inlet feed rollers including a pair of support members disposed on said apparatus for movement to change the direction of movement of said leading edge of said paper article when exiting said inlet feed rollers; and, said support members are mounted on said apparatus for pivotal movement about the axis of rotation of one of said feed rollers and said support members support the other of said feed rollers of said inlet feed roller pair.

2. The invention set forth in claim 1 wherein:

said buckle chute has a curved guide surface formed thereon for guiding a buckling portion of said paper article toward said exit feed rollers along said feed path.

3. The invention set forth in claim 1 including:

a guide plate disposed spaced from said guide surface on said buckle chute and between said inlet feed rollers and said exit feed rollers for guiding said paper article along said feed path.

4. The invention set forth in claim 1 wherein:

said support members are mounted on said apparatus for pivotal movement about the axis of rotation of one of said feed rollers and said support members support the other of said feed rollers of said inlet feed roller pair.

5. The invention set forth in claim 1 wherein:

said support members include means for yieldably biasing said other feed roller toward said one feed roller of said inlet feed roller pair.

6. The invention set forth in claim 1 including:

common drive means drivably engaged with at least one roller of said inlet feed roller pair and said exit feed roller pair, respectively.

7. The invention set forth in claim 6 wherein:

said common drive means comprises a drive gear meshed with cooperating drive gears operably connected to one roller of each of said pairs of rollers, respectively, and each of said pairs of rollers includes a second gear drivingly connected to the drive gear of said one roller of each pair of rollers, respectively, and drivingly connected to the other roller of each pair of rollers, respectively.

8. A paper folding apparatus including a folding station for forming a fold in a paper article in response to feeding said paper article to said folding station, comprising:

a buckle chute supported on said apparatus between a pair of inlet feed rollers and a pair of exit feed rollers, said pairs of feed rollers being arranged with respect to said buckle chute to form a substantially linear feed path for said paper article through said folding station in response to feeding a leading edge of said paper article into said buckle chute and continuing the feeding of said article to buckle said article to form said fold;

said inlet feed rollers are disposed on support means supported on said apparatus for pivotal movement to adjust the exit path of said article leaving said inlet feed rollers whereby said exit path may be selectively positioned in regard to an inlet to said buckle chute; and, said support means comprises a pair of spaced apart support members disposed for pivotal movement about the axis of rotation of one of said rollers of said inlet feed roller pair and the other roller of said inlet feed roller pair is supported on said support members for movement therewith to change said exit path of said paper article from said inlet feed roller pair.

9. A paper folding apparatus including a buckle chute for folding a paper article by feeding said article into said buckle chute and continuing the feeding of said article to form a buckled fold therein, said apparatus comprising:

a pair of inlet feed rollers and a pair of exit feed rollers disposed spaced apart from each other and spaced with respect to said buckle chute to form a feed path for a paper article entering said buckle chute, said inlet feed rollers being disposed on support means including a pair of spaced apart support members supporting one of said rollers of said inlet feed roller pair for disposition in a predetermined position about the axis of rotation of the other roller of said inlet feed roller pair for determining the path of a paper article exiting said inlet feed roller pair with respect to an inlet of said buckle chute, and said support members are mounted on said apparatus for pivotal movement about the axis of rotation of one of said feed rollers and said support members support the other of said feed rollers of said inlet feed roller pair.

10. A paper folding apparatus including prefeeding means for feeding paper articles seriatim to a folding station, said folding station being characterized by:

a buckle chute including an inlet and a guide surface for receiving the leading edge of a paper article and for guiding the formation of a fold of said paper article by buckling thereof;

a pair of inlet feed rollers disposed along a feed path between said prefeeding means and said buckle chute;

a pair of exit feed rollers disposed along said feed path in a direction of movement of said paper article downstream of said buckle chute, said inlet feed rollers and said exit feed rollers being arranged along a substantially linear feed path for said paper article through said folding station;

support means for said inlet feed roller pair for adjusting the attitude of the path of a leading edge of said paper article leaving said inlet feed roller pair and toward said buckle chute said support means for said inlet feed rollers including a pair of support members disposed on said apparatus for movement to change the direction of movement of said leading edge of said paper article when exiting said inlet feed rollers; and, said support members are mounted on said apparatus for pivotal movement about the axis of rotation of one of said feed rollers and said support members support the other of said feed rollers of said inlet feed roller pair.

11. The invention set forth in claim 10 including:

common drive means for rotatably driving said inlet feed roller pair and said exit feed roller pair, respectively.

12. The invention set forth in claim 11 wherein:

said common drive means comprises a drive pinion rotatably supported on said apparatus and meshed with a drive gear drivingly connected to one of said rollers of each of said feed roller pairs, respectively, and drive gears drivingly connected to the other roller of each of said feed roller pairs and meshed with said first mentioned drive gears, respectively.

* * * * *